US007697880B2

(12) United States Patent
Ito et al.

(10) Patent No.: US 7,697,880 B2
(45) Date of Patent: Apr. 13, 2010

(54) PROCESS CARTRIDGE AND IMAGE-FORMING DEVICE WITH BRUSH HOLDER MEMBER

(75) Inventors: Yoshinori Ito, Toyokawa (JP); Fumio Morita, Haguri-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 401 days.

(21) Appl. No.: 11/236,557

(22) Filed: Sep. 28, 2005

(65) Prior Publication Data

US 2006/0067726 A1 Mar. 30, 2006

(30) Foreign Application Priority Data

Sep. 30, 2004 (JP) ..... 2004-288282

(51) Int. Cl.
*G03G 21/00* (2006.01)

(52) U.S. Cl. ..... 399/353

(58) Field of Classification Search ..... 399/353–355, 399/345, 349, 119

See application file for complete search history.

(56) References Cited

U.S. PATENT DOCUMENTS 4,269,503 A * 5/1981 Nishikawa ..... 399/349
4,931,840 A * 6/1990 Tanzawa et al.
5,999,791 A * 12/1999 Ogawa et al. ..... 399/354
6,304,735 B1 * 10/2001 Nishimura et al. ..... 399/354
6,871,894 B2 * 3/2005 Zummack
7,024,150 B2 * 4/2006 Fukuta et al. ..... 399/345
2001/0026705 A1 * 10/2001 Sato et al.
2003/0224273 A1 * 12/2003 Koido et al.
2004/0062566 A1 * 4/2004 Kato et al. ..... 399/119

FOREIGN PATENT DOCUMENTS

JP 03288184 A * 12/1991
JP 06258984 A * 9/1994
JP 2001-159839 6/2001
JP 2001154549 A * 6/2001

* cited by examiner

*Primary Examiner*—Susan S Lee
(74) *Attorney, Agent, or Firm*—Banner & Witcoff, Ltd

(57) ABSTRACT

A process cartridge includes: an image bearing body; a brush member; a brush holder member; and a tension imparting portion. The image bearing body bears an image on its surface. The brush member removes deposits adhered to the surface of the image bearing body. The brush holder member extends along a longitudinal direction of the image bearing body and holds the brush member. The tension imparting portion imparts tension to the brush holder member in the longitudinal direction thereof.

19 Claims, 5 Drawing Sheets

PROCESS CARTRIDGE AND IMAGE-FORMING DEVICE WITH BRUSH HOLDER MEMBER

BACKGROUND OF THE INVENTION

1. Field of the Invention

The present invention relates to an image-forming device such as a laser printer and a process cartridge that is installed therein.

2. Description of Related Art

A process cartridge is installed in an image-forming device such as a laser printer. The process cartridge has components such as a photosensitive drum and a developing roller. An electrostatic latent image is formed on the photosensitive drum based on image data. The electrostatic latent image is developed into a toner image by the developing roller. The photosensitive drum and the developing roller are disposed facing each other, and are driven in rotation in predetermined directions. The electrostatic latent image formed on the surface of the photosensitive drum is developed into a toner image by toner supplied from the developing roller, when facing the developing roller. This toner image is then transferred to paper that is fed in between the photosensitive drum and the transfer roller, when the toner image faces the transfer roller that is disposed facing the photosensitive drum.

U.S. Pat. No. 6,304,735 B1 has proposed a paper dust removal device. The paper dust removal device is located in a process cartridge on the downstream side of the transfer roller in the direction of rotation of the photosensitive drum. The paper dust removal device removes paper dust that adheres to the surface of the photosensitive drum after the transfer. The paper dust removal device includes: a brush member formed from a sheet on which fibers are embedded, for scraping off the paper dust; and a conductive plate that holds the brush member thereon. The conductive plate is fastened by a screw onto a frame that supports the photosensitive drum. The brush member rubs against the surface of the photosensitive drum.

SUMMARY OF THE INVENTION

To achieve paper dust removal uniformly in the axial direction of the photosensitive drum, the surface of the conductive plate, on which the brush member is attached, is required to have a constant surface accuracy.

However, because the conductive plate is fastened to the frame simply by a screw, the conductive plate will possibly be bent. In such a case, the surface accuracy of the surface of the conductive plate, on which the brush member is held, will deteriorate.

An objective of the present invention is to provide a cartridge and an image-forming device that can ensure a high level of surface accuracy for the surface of a brush holder, on which a brush member is held, regardless of the precision at which the brush holder is mounted on the frame of the process cartridge.

In order to attain the above and other objects, the present invention provides a cartridge, including: an image bearing body; a brush member; a brush holder member; and a tension imparting portion. The image bearing body bears an image on its surface. The brush member removes deposits adhered to the surface of the image bearing body. The brush holder member extends along a longitudinal direction of the image bearing body and holds the brush member. The tension imparting portion imparts tension to the brush holder member in the longitudinal direction thereof.

According to another aspect, the present invention provides a drum cartridge, including: an image bearing drum; a brush member; a brush holder member; and a tension imparting portion. The image bearing drum bears an image on its surface. The brush member removes deposits adhered to the surface of the image bearing drum. The brush holder member extends along a longitudinal direction of the image bearing drum and that holds the brush member. The tension imparting portion imparts tension to the brush holder member in the longitudinal direction thereof.

According to another aspect, the present invention provides a process cartridge, including: a drum cartridge and a developing cartridge. The drum cartridge includes: an image bearing drum; a brush member; a brush holder member; and a tension imparting portion. The image bearing drum bears an image on its surface. The brush member removes deposits adhered to the surface of the image bearing drum. The brush holder member extends along a longitudinal direction of the image bearing drum and that holds the brush member. The tension imparting portion imparts tension to the brush holder member in the longitudinal direction thereof. The developing cartridge is detachably attached to the drum cartridge. The developing cartridge includes a developing roller. The developing roller supplies toner to the image bearing drum, thereby forming the image on the image bearing drum.

According to another aspect, the present invention provides an image forming device, including: a cartridge; and a conveying device. The cartridge includes: an image bearing body; a brush member; a brush holder member; and a tension imparting portion. The image bearing body bears an image on its surface. The brush member removes deposits adhered to the surface of the image bearing body. The brush holder member extends along a longitudinal direction of the image bearing body and that holds the brush member. The tension imparting portion imparts tension to the brush holder member in the longitudinal direction thereof. The conveying device conveys a recording medium to the image bearing body. The recording medium receives the image transferred from the image bearing body.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
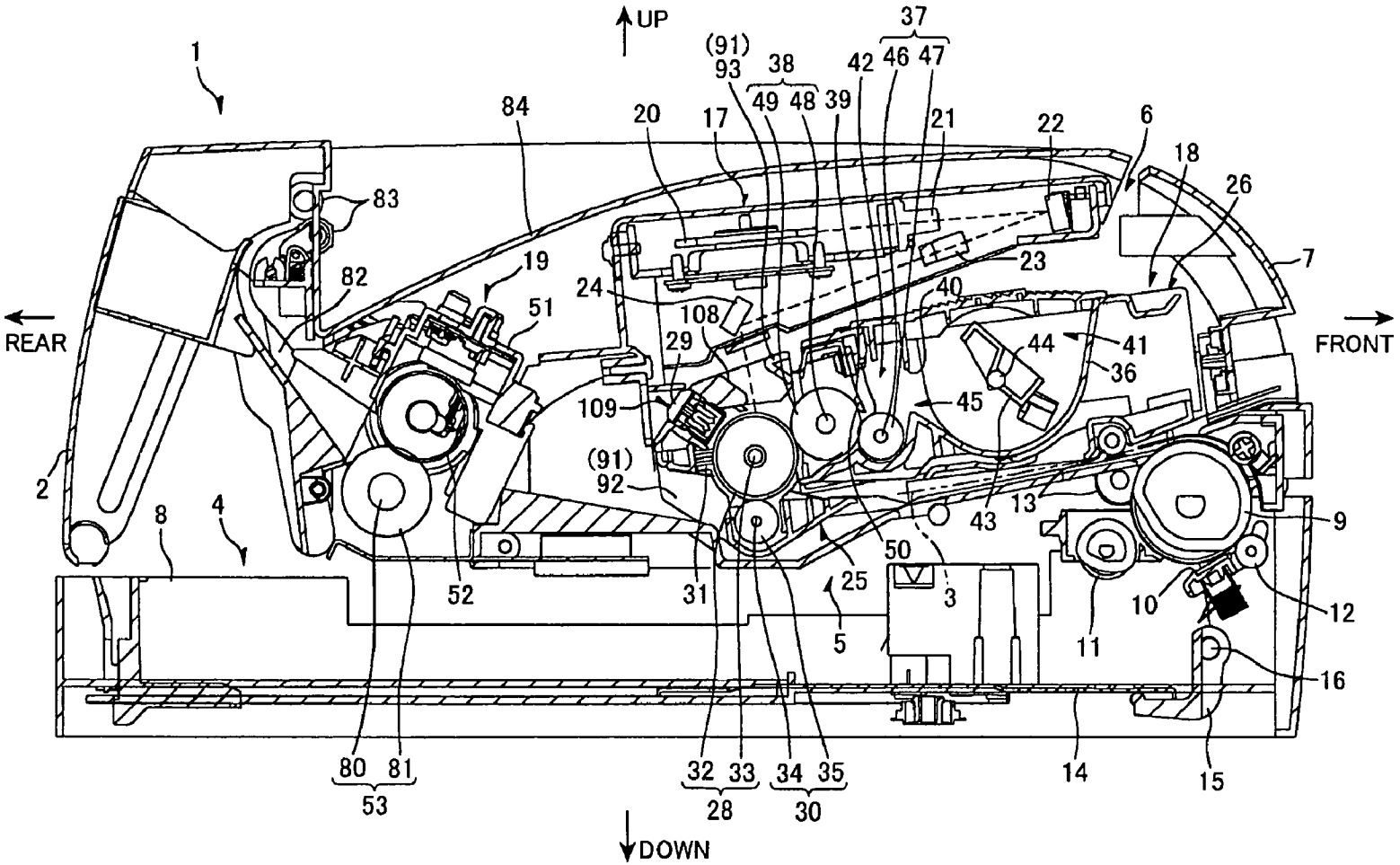
FIG. 1 is a side cross-sectional view of a laser printer according to a first embodiment, with the front cover closed.

A process cartridge and an image-forming device according to a preferred embodiment of the present invention will be described while referring to the accompanying drawings wherein like parts and components are designated by the same reference numerals to avoid duplicating description.

Figure 2:
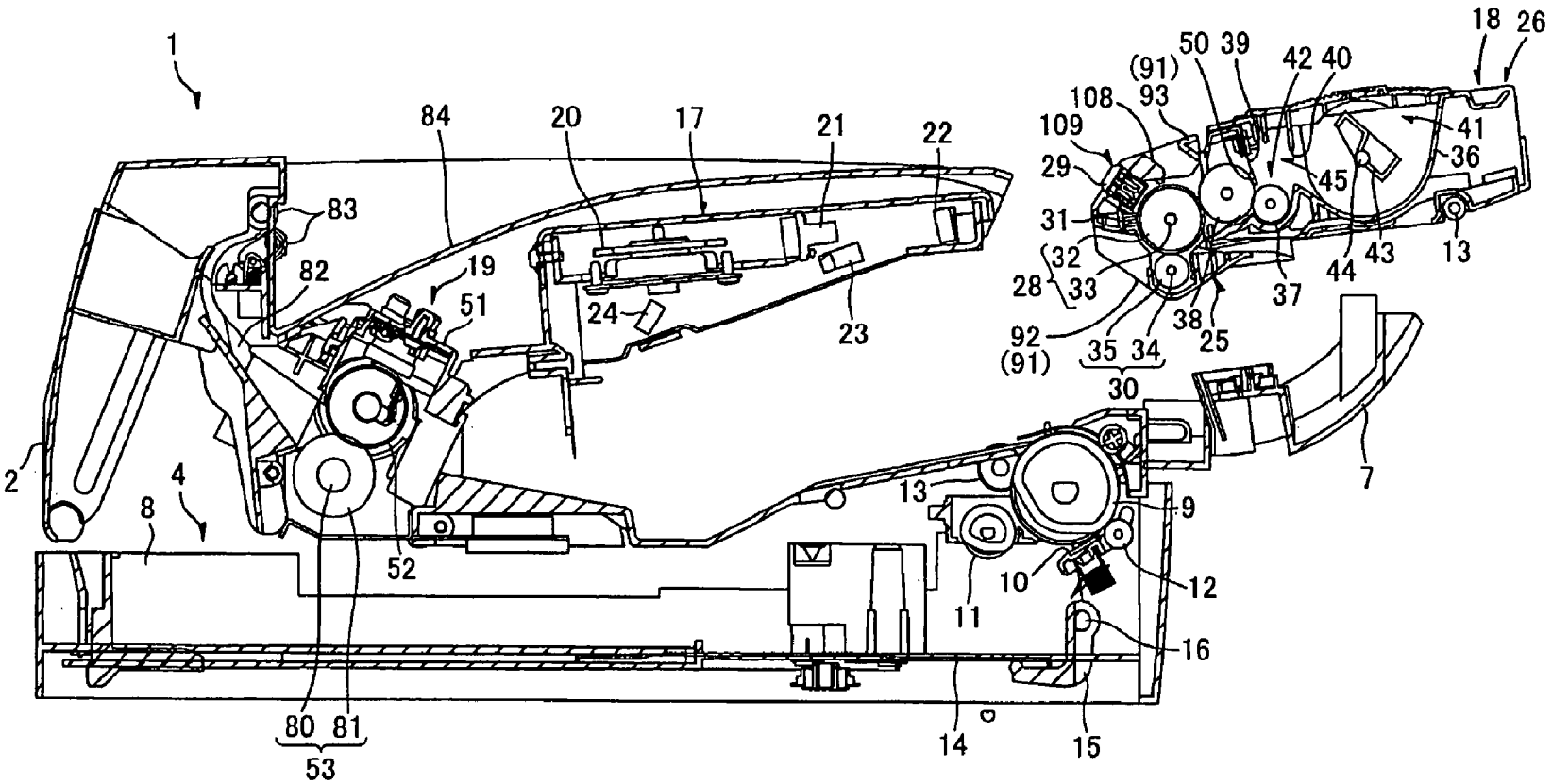
FIG. 2 is a side cross-sectional view of the laser printer of FIG. 1, with the front cover opened.

FIGS. 1 and 2 are side cross-sectional views showing the relevant configuration of a laser printer 1 according to the preferred embodiment.

As shown in the drawings, the laser printer 1 includes a main casing 2. Within the main casing 2, the laser printer 1 includes: a feeder unit 4 for feeding a paper 3; and an image-forming unit 5 for forming images on the paper 3 supplied from the feeder unit 4.

An access opening 6 is formed in one side wall of the main casing 2. A process cartridge 18 described later can be inserted into and removed from the main casing through the access opening 6. A front cover 7 is mounted on the main casing 2 over the access opening 6 to open and close the access opening 6.

The front cover 7 is rotatably supported by a cover shaft (not shown) that is inserted through a bottom end of the front cover 7. Accordingly, when the front cover 7 is rotated closed about the cover shaft, the front cover 7 covers the access opening 6 as shown in FIG. 1. When the cover 7 is rotated open in the clockwise direction in FIG. 1 about the cover shaft, the access opening 6 is exposed, as shown in FIG. 2, enabling the process cartridge 18 to be mounted into or to be removed from the main casing 2 via the access opening 6.

Hereinafter, the side of the laser printer 1, on which the front cover 7 is provided (the upstream side with respect to the mounting direction of the process cartridge 18), will be referred to as the "front side" and the opposite side as the "rear side." The "upper", "lower", "right", and "left" of the laser printer 1 are defined with respect to the "front side" and the "rear side." The right-to-left direction is defined as a "width-wise" direction of the laser printer 1.

The feeder unit 4 includes: a paper supply tray 8 that is detachably mounted in the lower section of the main casing 2; a feeding roller 9 and a separating pad 10 which are disposed above the front end of the paper supply tray 8; a pickup roller 11 disposed on the rear side of the feeding roller 9; a pinch roller 12 disposed in opposition to the feeding roller 9 on the lower front side thereof; and a pair of registration rollers 13 disposed on the upper rear side of the feeding roller 9.

The paper supply tray 8 can be removed from the laser printer 1 by moving the paper supply tray 8 forwardly through the front side of the laser printer 1.

A paper pressing plate 14 is provided inside the paper supply tray 8 for supporting thereon the paper 3 in a stacked state. The paper pressing plate 14 is pivotably supported on the rear end thereof, so that the front end can move vertically. A lever 15 is provided in the front section of the paper supply tray 8 for lifting the front end of the paper pressing plate 14. The lever 15 has a substantially L-shaped cross section to bend around the front end of the paper pressing plate 14 and extend under the bottom surface of the paper pressing plate 14. The top end of the lever 15 is attached to a lever shaft 16 disposed on the front end of the paper supply tray 8, while the rear end of the lever 15 contacts the under surface of the paper pressing plate 14 near the front end thereof. When the lever shaft 16 is driven to rotate clockwise in the drawings, the lever 15 rotates about the lever shaft 16, and the rear end of the lever 15 lifts the front end of the paper pressing plate 14.

When the front end of the paper pressing plate 14 is lifted, the topmost sheet of the paper 3 stacked on the paper pressing plate 14 is pressed against the pickup roller 11. The pickup roller 11 rotates to begin conveying the topmost sheet of the paper 3 between the feeding roller 9 and separating pad 10.

However, when the paper supply tray 8 is removed from the main casing 2, the front end of the paper pressing plate 14 drops downward due to its own weight and rests on the bottom surface of the paper supply tray 8. In this state, the paper 3 can be supported in a stacked form on the paper pressing plate 14.

When the pickup roller 11 conveys a sheet of the paper 3 toward a nip part between the feeding roller 9 and separating pad 10, the paper 3 becomes interposed between the feeding roller 9 and separating pad 10 by the rotation of the feeding roller 9 and is reliably separated and fed one sheet at a time. The separated sheet of paper 3 is fed between the feeding roller 9 and pinch roller 12 and conveyed to the registration rollers 13. After adjusting the registration of the paper 3, the registration rollers 13 is convey the sheet of paper 3 to a transfer position in the image-forming unit 5 (a nip portion between a photosensitive drum 28 and a transfer roller 30 described later), at which a toner image formed on the photosensitive drum 28 is transferred onto the paper 3.

The image-forming unit 5 includes a scanning unit 17, the process cartridge 18, and a fixing unit 19.

The scanning unit 17 is disposed in the top section of the main casing 2, and includes: a laser light source (not shown); a polygon mirror 20 that is driven to rotate; a fθ lens 21; a reflecting mirror 22; a lens 23; and a reflecting mirror 24. The laser light source emits a laser beam based on image data. As illustrated by a broken line in FIG. 1, the laser beam is deflected by the polygon mirror 20, passes through the fθ lens 21, and is reflected rearward by the reflecting mirror 22. After passing-through the lens 23, the laser beam is reflected downward by the reflecting mirror 24 and irradiated on the surface of the photosensitive drum 28 in the process cartridge 18.

The process cartridge 18 is detachably mounted in the main casing 2 beneath the scanning unit 19. The process cartridge 18 is oriented with its front, rear, upper, lower, right, and left sides being directed in the front, rear, upper, lower, right, and left sides, respectively, of the laser printer 1. Now, the width-wise direction W of the process cartridge 18 is defined as a right-to-left direction that is orthogonal to both of the front-to-rear direction and the upper-to-lower direction of the process cartridge 18. The process cartridge 18 is mounted in the main casing 2, with its widthwise direction W being in parallel with the widthwise direction of the laser printer 1.

The process cartridge 18 includes: a drum cartridge 25; and a developing cartridge 26 that is detachably mounted on the drum cartridge 25.

The developing cartridge 26 is mounted on the front side of the drum cartridge 25. The drum cartridge 25 has a frame 91. The photosensitive drum 28, a Scorotron type charger 29, the transfer roller 30, and a brush member 31 are mounted within the frame 91.

The frame 91 includes a lower frame 92 and an upper frame 93 which are separate from each other. The upper frame 93 is combined with the lower frame 92 from above. The lower frame 92 functions as a housing.

Figure 3:
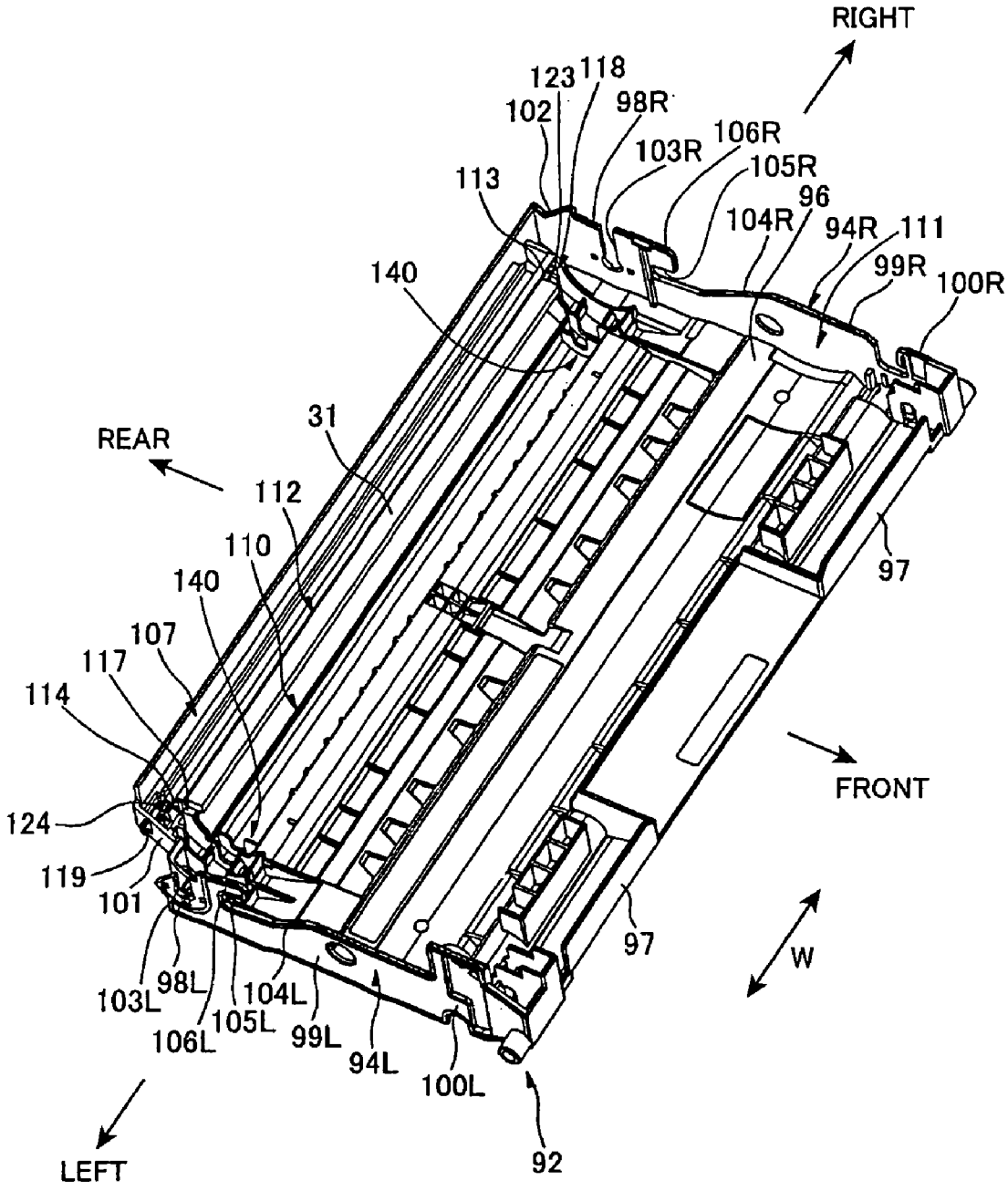
FIG. 3 is a perspective view of a lower frame shown in FIG. 1.

As shown in FIG. 3, the lower frame 92 has: a left-side wall 94L; a right-side wall 94R; a bottom wall 96; and a front wall 97 which are formed integrally with one another.

The left-side wall 94L and the right-side wall 94R are disposed facing each other with a gap therebetween in the widthwise direction W. The left-side wall 94L has a left-rear-side wall portion 98L, a left-front-side wall portion 99L, and a left-extension-side wall portion 100L, which are formed sequentially from the rear side to the front side. Similarly, the right-side wall 94R has a right-rear-side wall portion 98R, a right-front-side wall portion 99R, and a right-extension-side wall portion 100R, which are formed sequentially from the rear side to the front side.

The left-side wall 94L is integrally formed with a brush left-side wall portion 101. The brush left-side wall portion 101 protrudes inward in the widthwise direction W from the rear edge of the left-rear-side wall portion 98L, and extends towards the rear.

The right-side wall 94R is formed integrally with a brush right-side wall portion 102. The brush right-side wall portion 102 extends rearward from the rear edge of the right-rear-side wall portion 98R, on the same plane as the right-rear-side wall portion 98R.

A right-side transfer-roller-shaft bearing portion 103R is formed in the upper edge of the right-rear-side wall portion 98R by cutting downward in a substantially U-shape. Similarly, a left-side transfer-roller-shaft bearing portion 103L is formed in the upper edge of the left-rear-side wall portion 98L by cutting downward in a substantially U-shape. The transfer-roller-shaft bearing portions 103R and 103L can receive thereon shaft end portions of the transfer roller 30.

The right-front-side wall portion 99R is provided with a right-side developing-roller-shaft guide portion 104R and a right-side developing-roller-shaft bearing portion 105R. Similarly, the left-front-side wall portion 99L is provided with a left-side developing-roller-shaft guide portion 104L and a left-side developing-roller-shaft bearing portion 105L.

The right-side developing-roller-shaft guide portion 104R is formed as the upper edge of the right-front-side wall portion 99R. The right-side developing-roller-shaft guide portion 104R is formed to extend diagonally downward from the midway to rear along the right-front-side wall portion 99R in the front-to-rear direction. The right-side developing-roller-shaft guide portion 104R further extends substantially flat in the horizontal direction along the right-front-side wall portion 99R in the front-to-rear direction.

A right-side protruding wall 106R continues on from the rear of the right-side developing-roller-shaft guide portion 104R, and protrudes upwardly from the rear edge of the right-side developing-roller-shaft guide portion 104R. The right-side developing-roller-shaft bearing portion 105R is formed in the front edge of the right-side protruding wall 106R in a substantially rectangular-shaped cutout. Accordingly, the front edge of the right-side developing-roller-shaft bearing portion 105R continues on from the rear edge of the right-side developing-roller-shaft guide portion 104R.

The left-side developing-roller-shaft guide portion 104L is formed as the upper edge of the left-front-side wall portion 99L. The left-side developing-roller-shaft guide portion 104L is formed to extend diagonally downward from the midway to rear along the left-front-side wall portion 99L in the front-to-rear direction. The left-side developing-roller-shaft guide portion 104L further extends substantially flat in the horizontal direction along the left-front-side wall portion 99L in the front-to-rear direction.

A left-side protruding wall 106L continues on from the rear of the left-side developing-roller-shaft guide portion 104L, and protrudes upwardly from the rear edge of the left-side developing-roller-shaft guide portion 104L. The left-side developing-roller-shaft bearing portion 105L is formed in the front edge of the left-side protruding wall 106L in a substantially rectangular-shaped cutout. Accordingly, the front edge of the left-side developing-roller-shaft bearing portion 105L continues on from the rear edge of the left-side developing-roller-shaft guide portion 104L.

Thus, each developing-roller-shaft guide portion 104R, 104L is designed to guide the corresponding end portion of the developing roller shaft 48, which will be described later, when the developing cartridge 26 is removed from or inserted into the drum cartridge 25. Each developing-roller-shaft bearing portion 105R, 105L is designed so that the corresponding end portion of the developing roller shaft 48 that is guided on the corresponding developing-roller-shaft guide portion 104R, 104L enters therein.

The right-extension-side wall portion 100R is formed to continue on from the right-front-side wall portion 99R on the same plane with the right-front-side wall portion 99R. Similarly, the left-extension-side wall portion 100L is formed to continue on from the left-front-side wall portion 99L on the same plane with the left-front-side wall portion 99L.

The bottom wall 96 is substantially of a flat plate shape. The bottom wall 96 is provided to connect together the lower edge of the left-side wall 94L and the lower edge of the right-side wall 94R over their entire lengths along the front-to-rear direction.

A brush lower wall portion 117 is defined as a rear part of the bottom wall 96 that is located at a region between the brush left-side wall portion 101 and the brush right-side wall portion 102 and that rises or slopes gradually upwardly toward the rear edge of the lower frame 92. The brush lower wall portion 117 extends in the widthwise direction W of the lower frame 92 between the left-side wall portion 101 and the brush right-side wall portion 102 and in the front-to-rear direction within the rear part of the bottom wall 96.

The front wall 97 is divided into two end portions in the widthwise direction W. Each end portion of the front wall 97 is bent upward at right angles from the front edge of the bottom wall 96.

As shown in FIGS. 1 and 2, a laser incidence window 108 opens through an upper part of the upper frame 93. The laser incidence window 108 extends in the widthwise direction W (direction normal to the sheets of FIGS. 1 and 2) and is substantially rectangular in shape. A charger mounting unit 109 is provided in the upper frame 93, at a location diagonally downward from the rear of the laser incidence window 108. The charger mounting unit 109 supports the charger 29 thereon.

When the lower frame 92 and the upper frame 93 are assembled together, a drum accommodating portion 110 (see FIG. 3) is formed as a space surrounded by: the left-rear-side wall portion 98L; the right-rear-side wall portion 98R; the upper frame 93; and a portion of the bottom wall 96 that is located between the left-rear-side wall portion 98L and the right-rear-side wall portion 98R in the widthwise direction W and that faces the upper frame 93 in the vertical direction. The drum accommodating portion 110 is formed as a space with its front being opened. The photosensitive drum 28 is provided within the drum accommodating portion 110 (see FIG. 3).

A developing cartridge accommodating portion 111 (see FIG. 3) is formed as a space surrounded by: the left-front-side wall portion 99L; the right-front-side wall portion 99R; and a part of the bottom wall 96 that is located between the front-side wall portions 99L and 99R in the widthwise direction W and that is in continuation with the front-side wall portions 99L and 99R. The developing cartridge accommodating portion 111 is formed as a space with its upper front being opened. The developing cartridge accommodating portion 111 houses therein the developing cartridge 26.

As shown in FIG. 1, the photosensitive drum 28 includes: a main drum body 32 that is cylindrical in shape; and a drum shaft 33 extending along the axial center of the main drum body 32 in the longitudinal direction thereof. The main drum body 32 has, on its outer surface, a photosensitive layer formed of polycarbonate or the like that has a positively charging nature. The drum shaft 33 is fixedly secured to both of the left-side wall 94L and the right-side wall 94R of the drum cartridge 25. The drum shaft 33 is unable to rotate relative to the side plates 94R and 94L. The main drum body 32 is rotatably supported on the drum shaft 33. With this construction, the photosensitive drum 28 is disposed between the left-side wall 94L and the right side wall 94R and capable of rotating about the drum shaft 33. During an image forming process, the photosensitive drum 28 rotates clockwise in FIG. 1.

The charger 29 is mounted on the charger mounting unit 109 diagonally above and rearward of the photosensitive drum 28. The charger 29 is disposed in opposition to but separates a prescribed distance from the photosensitive drum 28 so as not to contact the same. The charger 29 is a positively charging Scorotron charger that generates a corona discharge from a wire formed of tungsten or the like, and can form a uniform charge of positive polarity over the surface of the photosensitive drum 28.

The transfer roller 30 is rotatably supported on transfer-roller support wall portions 140 which are formed on the bottom wall 96 as shown in FIG. 3. The transfer roller 30 is positioned at a location below the photosensitive drum 28, and opposes and contacts the bottom surface of the photosensitive drum 28 in a vertical direction so as to form a nip part with the photosensitive drum 28. The transfer roller 30 is configured of a metal roller shaft 34 that is covered with a roller formed of an ionic conductive rubber material. During a transfer operation, a transfer bias is applied to the transfer roller 30.

Figure 5:
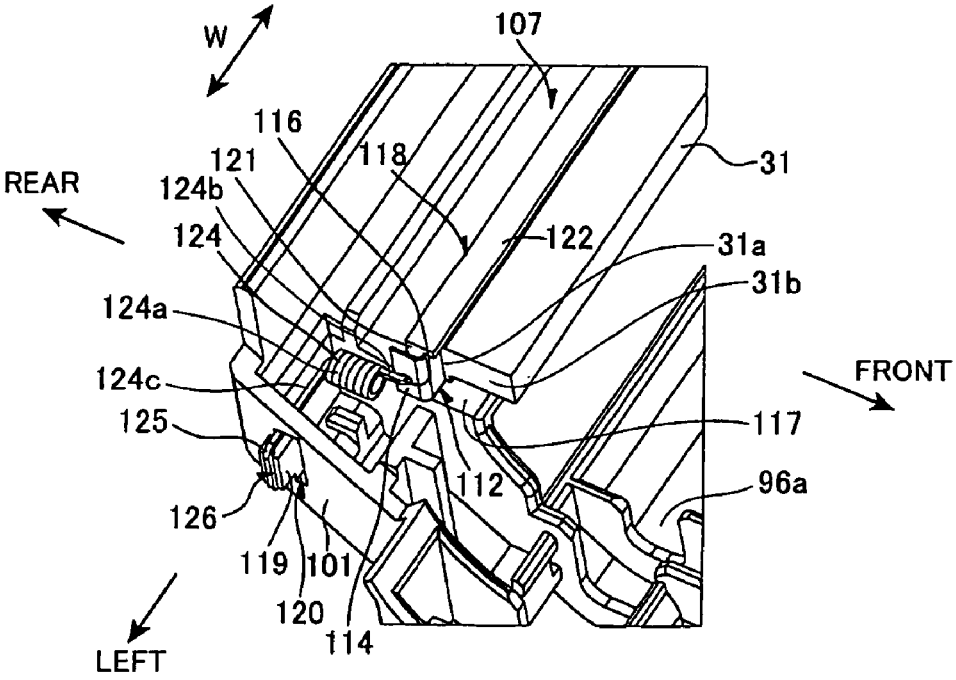
FIG. 5 is a perspective view showing the left end portion of the lower frame shown in FIG. 3.

As shown in FIG. 5, an aperture 120 is formed through the brush left-side wall portion 101. An engagement protrusion 119 is provided on the brush left-side wall portion 101, protruding outward (leftward) from within the aperture 120 in the widthwise direction W. The engagement protrusion 119 has a substantially rectangular parallelepiped shape. A groove 126 is formed to extend vertically on the left end surface (outer surface) of the engagement protrusion 119.

A brush accommodating portion 107 is defined as a space surrounded by the brush left-side wall portion 101, the brush right-side wall portion 102, and the brush lower wall portion 117. The brush member 31 is mounted in the brush accommodating portion 107. The brush member 31 has a sheet 31*a*, on which fibers 31*b* are implanted as shown in FIG. 5. The sheet 31*a* and the fibers 31*b* are made of electrically conductive material.

More specifically, as shown in FIGS. 3 and 5, a brush-support wall 118 rises from the brush lower wall portion 117 of the bottom wall 96. The brush-support wall 118 is elongated in the widthwise direction W. The brush-support wall 118 is located in the rear side of the photosensitive drum 28 and at a distance therefrom. The position of the brush-support wall 118 in the front-to-rear direction is forward from the position of the engagement protrusion 119 in the front-to-rear direction as shown in FIG. 5. The brush member 31 is mounted via a brush-holder 112 on the front surface of the brush-support wall 118 that faces the photosensitive drum 28, with the tip ends of the fibers 31*b* touching the photosensitive drum 28 from the rear.

The brush-support wall 118 has a substantially L-shaped cross-section in the front-to-rear direction. The brush-support wall 118 includes a rising part 121 and an upper-front-edge projection 122 which are formed integrally with each other. The rising part 121 is of a rectangular plate shape. The upper-front-edge projection 122 projects from an upper-front edge of the rising part 121 in a forward direction towards the photosensitive drum 28. The upper-front-edge projection 122 extends along the entire length of the rising part 121 in its longitudinal direction, that is, in the widthwise direction W.

Figure 4:
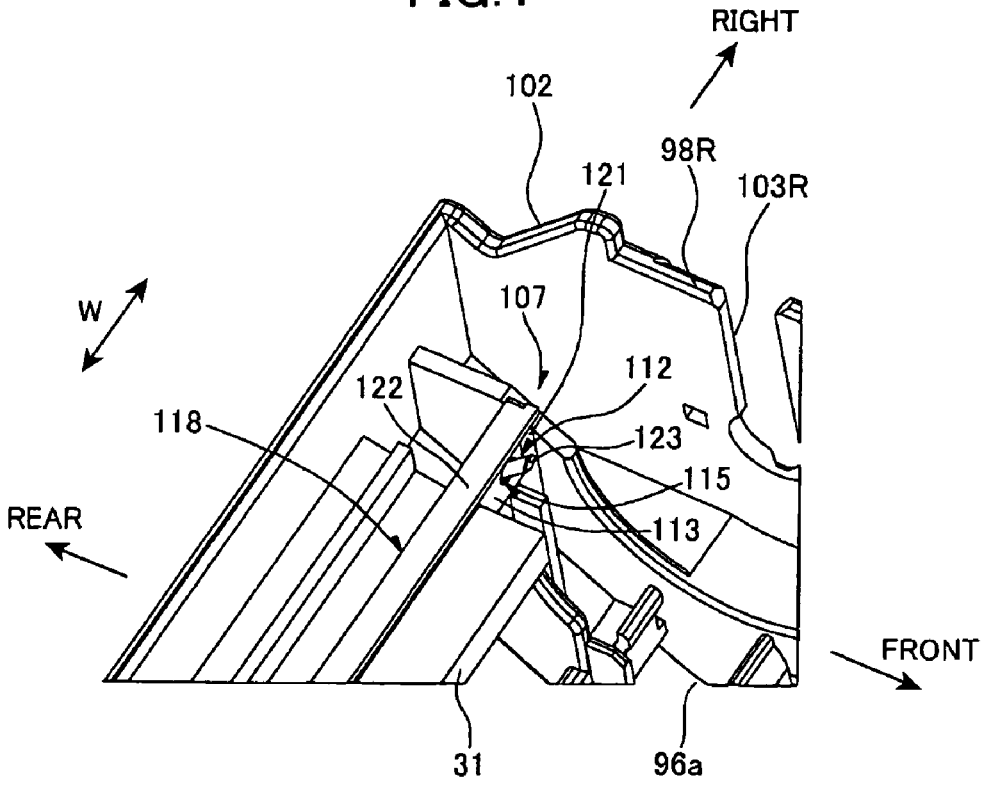
FIG. 4 is a perspective view showing the right end portion of the lower frame shown in FIG. 3.

As shown in FIG. 4, the brush-support wall 118 further includes a pin-shaped protrusion 123 at the right edge of the rising part 121. The pin-shaped protrusion 123 protrudes from the front surface of the rising part 121 diagonally to the right, in the longitudinal direction of the brush-support wall 118. In other words, the pin-shaped protrusion 123 protrudes from the front surface of the rising part 121 in a direction slanted forwardly-and-rightwardly.

The brush-holder 112 is of a thin, substantially rectangular elongated shape. The brush-holder 112 is formed from a flexible, film-shaped thin metal plate. The brush-holder 112 can be formed of a thin plate of a metal, such as stainless steel, aluminum, or iron, of a thickness of about 0.1 mm, by way of example. Note that if a thin metal plate of iron is used as the brush-holder 112, the surface of the brush-holder 112 is preferably covered with nickel plating to prevent rusting.

More specifically, the brush-holder 112 has a brush-holding part 113 and a left-end extension 114, which are formed integrally with each other. The left-end extension 114 extends from the left end of the brush-holding part 113 perpendicularly thereto.

The brush-holder 112 is disposed on the brush-support wall 118, with the brush-holding part 113 being disposed on the front surface of the rising part 121 that faces the photosensitive drum 28 and the left-end extension 114 being disposed to extend towards the rear along the left-side end of the rising part 121.

The brush-holding part 113 has a rectangular shape that is longer than the sheet 31*a* of the brush member 31 in the widthwise direction W. The sheet 31*a* of the brush member 31 is attached, via an electrically-conductive double-sided adhesive tape, on the front surface of the brush-holding part 113 that faces the photosensitive drum 28.

As shown in FIG. 4, the brush-holding part 113 is formed with a through-hole 115 at its right-side edge that is not covered by the sheet 31*a* of the brush member 31 but is exposed. The pin-shaped protrusion 123 passes through the through-hole 115. Thus, the right end of the brush holder 112 is fixed to the brush support wall 118 by the engagement between the pin-shaped protrusion 123 and the through-hole 115.

The brush holder 112 is connected via a spring 124 to the engagement protrusion 119 on the brush left-side wall portion 101. More specifically, as shown in FIG. 5, a connection through-hole 116 is formed through the left-end extension 114. The spring 124 includes: a coil portion 124*a*; a first straight wire portion 124*b* extending from one end of the coil portion 124*a*; and a second straight wire portion 124*c* extending from the other end of the coil portion 124*a*. A free end of the first straight wire portion 124*b* is engaged with the connection through-hole 116. The coil portion 124*a* is a tension spring to generate force of contraction. The coil portion 124*a* is oriented with its axis extending in the front-to-rear direction to expand and contract in the front-to-rear direction. The coil portion 124*a* is located on the side of the brush-support wall 118 with respect to the brush holder 112. The position of the coil portion 124*a* in the front-to-rear direction is between the position of the brush-support-wall 118 in the front-to-rear direction and the position of the groove 126 on the engagement protrusion 119 in the front-to-rear direction.

The second straight wire portion 124*c* extends from the end of the coil portion 124*a* leftwardly in the widthwise direction W, passes through the aperture 120 of the brush left-side wall portion 101 along the upper surface of the engagement protrusion 119, to extend outward from the brush left-side wall portion 101. The second straight wire portion 124*c* is then bent, at its portion that protrudes outside the brush left-side wall portion 101, to extend downwardly along the groove 126 on the left end surface of the engagement protrusion 119, and to extend inwardly in the widthwise direction W along the under surface of the engagement protrusion 119, thereby forming a substantially U-shaped hook portion 125. Thus, the second straight wire portion 124*c* is engaged with the groove 126 on the engagement protrusion 119 at the U-shaped hook portion 125. This configuration ensures that the left-end extension 114 of the brush-holder 112 is pulled rearward by the spring force of the spring 124. The brush-holding part 113 of the brush-holder 112 is pressed against the rising part 121 of the brush-support wall 118, and is also applied with a tension in the longitudinal direction thereof.

When the process cartridge 18 is mounted in the main casing 2 as shown in FIG. 1, the hook portion 125 is electrically connected to a power-supply device (not shown) that is disposed within the main casing 2. The hook portion. 125 acts as an electrode to apply the brush holder 112 with a cleaning bias voltage. Deposits that adhere to the surface of the photosensitive drum 28 are electrically attracted onto the brush member 31 according to the cleaning bias.

The developing cartridge 26 is detachably inserted into the drum cartridge 25 as shown in FIG. 1. The developing cartridge 26 has a developing cartridge housing 36 of a box shape with its rear side being opened. A supply roller 37, a developing roller 38, and a thickness regulating blade 39 are mounted within the developing cartridge housing 36. The developing cartridge 26 can be removed from and inserted into the main casing 2 in an integral manner with the drum cartridge 25.

As shown in FIG. 1, a partitioning plate 40 is provided within the developing cartridge housing 36 to protrude downward from the upper surface thereof. The partitioning plate 40 extends in the widthwise direction of the developing cartridge housing 36. The interior space of the developing cartridge housing 36 in front of the partitioning plate 40 acts as a toner accommodating chamber 41, and the interior space of the developing cartridge housing 36 in the rear side of the partitioning plate 40 acts as a developing chamber 42.

The toner accommodating chamber 41 is filled with a non-magnetic, single-component toner having a positive charging nature. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, and wax, as well as an external additive such as silica to improve fluidity. The average diameter of the toner particles is about 6-10 μm.

An agitator 43 is mounted in the toner accommodating chamber 41. The agitator 43 is supported on a rotational shaft 44 which is located in the central portion of the toner accommodating chamber 41 and which extends in the widthwise direction. When the agitator 43 rotates about the rotational shaft 44, the agitator 43 stirs toner in the toner accommodating chamber 41, discharging toner through an opening 45, which is formed under the partitioning plate 40, toward the supply roller 37.

The supply roller 37 is disposed in the bottom front side of the interior of the developing chamber 42. The supply roller 37 is rotatably supported between the side plates of the developing cartridge housing 36 that face each other in the widthwise direction of the developing cartridge housing 36. The supply roller 37 includes: a supply roller shaft 46 made of metal; and a sponge roller 47. The roller shaft 46 extends in the widthwise direction of the developing cartridge housing 36. The sponge roller 47 covers the periphery of the supply roller shaft 46. The sponge roller 47 is formed of an electrically conductive foam material.

The developing roller 38 is disposed in the bottom rear of the interior of the developing chamber 42. The developing roller 38 is rotatably supported between the side plates of the developing cartridge housing 36 that face each other in the widthwise direction of the developing cartridge housing 36. The developing roller 38 is disposed in such a manner that part of the surface thereof protrudes rearward from the developing cartridge housing 36 and is exposed therefrom. This ensures that the developing roller 38 faces the photosensitive drum 28 in the front-to-rear direction and is brought into contact therewith when the developing cartridge 26 is mounted in the drum cartridge 25. The developing roller 38 has the developing roller shaft 48 and a rubber roller 49. The developing roller shaft 48 is made of metal. The rubber roller 49 covers the periphery of the developing roller shaft 48. The rubber roller 49 is made of an electrically conductive rubber material. More specifically, the rubber roller 49 is formed of an electrically conductive urethane rubber or silicone rubber containing fine carbon particles or the like. The surface of the rubber roller 49 is covered with urethane rubber or silicone rubber containing fluorine. The rubber roller 49 is disposed so as to be pressed against the sponge roller 47 of the supply roller 37.

The thickness regulating blade 39 includes: a main blade configured of a metal leaf spring; and a pressing portion 50 provided on the end of the main blade member. The pressing portion 50 has a semicircular cross section and is formed of an insulating silicone rubber. The thickness regulating blade 39 is supported on the developing cartridge housing 36 above the developing roller 38, with its lower end facing the rubber roller 49 of the developing roller 38 from the front side thereof. With this construction, the elastic force of the thickness regulating blade 39 causes the pressing portion 50 to contact the rubber roller 49 with pressure.

As the agitator 43 rotates, toner is discharged through the opening 45 into the developing chamber 42. As the supply roller 37 rotates, toner is supplied onto the rubber roller 49 of the developing roller 38. Toner is positively charged by friction between the sponge roller 47 of the supply roller 37 and the rubber roller 49 of the developing roller 38. As the developing roller 38 rotates, toner that has been supplied onto the rubber roller 49 enters between the pressing portion 50 of the thickness regulating blade 39 and the rubber roller 49. As a result, toner becomes supported in a thin film of a constant thickness on the rubber roller 49.

As the photosensitive drum 28 rotates, the charger 29 charges the surface of the photosensitive drum 28 with a uniform positive polarity. Subsequently, a laser beam emitted from the scanning unit 19 based on image data is scanned at a high speed over the surface of the photosensitive drum 28, forming an electrostatic latent image corresponding to the image data.

Next, positively charged toner carried on the rubber roller 49 of the developing roller 38 comes into contact with the photosensitive drum 28 as the developing roller 38 rotates, and is supplied to areas on the surface of the positively charged photosensitive drum 28 that have been exposed to the laser beam and, therefore, that have a lower potential. In this way, the latent images on the photosensitive drum 28 are transformed into visible images so that a reverse development image is formed on the surface of the photosensitive drum 28.

Subsequently, the photosensitive drum 28 and the transfer roller 30 are driven in rotation to hold and feed the paper 3 therebetween. The paper 3 is fed between the photosensitive drum 28 and the transfer roller 30, and the toner image that is supported on the surface of the photosensitive drum 28 is transferred onto the paper 3.

Note that after this transfer, due to contact with the paper 3, deposits such as paper dust adhere to the surface of the photosensitive drum 28. As the photosensitive drum 28 rotates, the surface of the photosensitive drum 28, to which the deposits adhere, faces the brush member 31. At that time, the deposits are physically entrapped by the brush member 31 and are electrically attracted by the cleaning bias applied to the brush member 31 from the hook portion 125 through the brush-holder 112.

The fixing unit 19 is disposed on the rear side of the process cartridge 18 and includes a frame 51, and a heating roller 52 and a pressure roller 53. The heating roller 52 and the pressure roller 53 are mounted within the frame 51. The frame 51 extends in the widthwise direction of the laser printer 1. The heating roller 52 is rotatably supported in the frame 51. The heating roller 52 and the pressure roller 53 face each other in the vertical direction.

The heating roller 52 includes a metal tube and a halogen lamp disposed inside the tube for heating the same. The heating roller 52 is driven to rotate by a driving force inputted from a motor (not shown).

The pressure roller 53 is disposed below and in opposition to the heating roller 52 and contacts the heating roller 52 with pressure. The pressure roller 53 is configured of a roller shaft 80 made of metal and covered with a roller 81 that is formed of a rubber material. The pressure roller 53 follows the rotational drive of the heating roller 52.

In the fixing unit 19, toner transferred onto the paper 3 at the transfer position is fixed to the paper 3 by heat as the paper 3 passes between the heating roller 52 and pressure roller 53. After the fixing process, the paper 3 is conveyed along a discharge path 82 that extends vertically to lead up to the top surface of the main casing 2. Discharge rollers 83 provided at the top of the discharge path 82 discharge the paper 3 onto a discharge tray 84 formed on the top surface of the main casing 2.

As described above, according to the present embodiment, the brush member 31 is affixed to the brush-holder 112 that is formed of a film-shaped, elongated thin metal plate. The through-hole 115 is formed through one end portion of the brush-holder 112, and one end of the spring 124 is connected to the other end portion of the brush-holder 112. The pin-shaped protrusion 123 is provided on the front surface of the brush-support wall 118 that faces the photosensitive drum 28. The pin-shaped protrusion 123 is engaged in the through-hole 115. The hook portion 125 provided at the other end of the spring 124 is engaged with the engagement protrusion 119 on the brush left-side wall portion 101. This ensures that a tension can be imparted reliably in the longitudinal direction of the brush-holder 112 by the spring force of the spring 124, while the brush-holder 112 can be fastened reliably onto the brush-support wall 118.

Thus, tension is imparted in the longitudinal direction of the brush-holding part 113 of the brush-holder 112 by the spring force of the spring 124. For that reason, the brush-holding part 113, on which the sheet 31*a* of the brush member 31 is attached, can have a high surface accuracy, regardless of the mounting precision, at which the brush holder 112 is mounted on the rising part 121 of the brush-support wall 118. Thus, the brush member 31 can be kept in contact with the surface of the photosensitive drum 28 uniformly in the axial direction of the photosensitive drum 28. As a result, the brush member 31 can succeed in uniformly removing deposits that adhere to the surface of the photosensitive drum 28.

Since the left-end extension 114 is pulled rearward by the spring force of the spring 124, the brush-holding part 113 of the brush-holder 112 is pressed against the rising part 121 of the brush-support wall 118. This can prevent the brush-holding part 113 of the brush-holder 112 from separating from the rising part 121. Reliable contact of the brush member 31 with respect to the photosensitive drum 28 can therefore be ensured. As a result, deposits adhering to the surface of the photosensitive drum 28 can be removed uniformly.

The one end of the brush-holder 112 is held by the pin-shaped protrusion 123, while the other end is pulled by the spring 124. The upper-front-edge projection 122 projects towards the photosensitive drum 28 from the upper front edge of the rising part 121, thereby preventing the central portion of the brush-holder 112 in its longitudinal direction from being shifted upwardly. In other words, the brush-holder 112 is prevented from moving towards the downstream side in the direction of rotation of the photosensitive drum 28, even through a force acts on the brush member 31 towards the downstream side in the direction of rotation of the photosensitive drum 28 as the photosensitive drum 28 rotates. The brush member 31 is prevented from moving towards the downstream side in the direction of rotation of the photosensitive drum 28 as the photosensitive drum 28 rotates. A reliable contact can therefore be ensured between the brush member 31 and the photosensitive drum 28. As a result, deposits adhering to the surface of the photosensitive drum 28 can be removed more uniformly.

The pin-shaped protrusion 123 protrudes from the brush-support wall 118, and passes through the through-hole 115 of the brush-holder 112 so as to be engaged with the brush-holder 112 at the through-hole 115. The hook portion 125 of the spring 124 is engaged with the engagement protrusion 119 of the brush left-side wall portion 101. This configuration ensures that the brush-holder 112 can be reliably fastened to the rising part 121 of the brush-support wall 118. At the same time, a tension can be imparted reliably to the brush-holder 112 in the longitudinal direction of the brush-holder 112 by the spring force of the spring 124.

It is conceivable to use a double-sided tape to fasten the brush-holder 112 to the rising part 121. In this case, however, some part of the double-sided tape will remain attached to the brush-holder 112 when the brush-holder 112 is removed from the rising part 121 to exchange the brush member 31 with a new one. It will be difficult to recycle the brush-holder 112.

In contrast to the above-described conceivable configuration, according to the configuration of the present embodiment, the pin-shaped protrusion 123 is first passed through the through-hole 115 of the brush-holder 112. Then, the hook portion 125 is engaged with the engagement protrusion 119. With such a simple workflow, the brush-holder 112 can be mounted on the rising part 121. Because no double-sided tape is used to attach the brush-holder 112 onto the rising part 121, there is no inconvenience caused by any double-sided tape remaining attached to the brush-holder 112 when the brush-holder 112 is removed from the rising part 121. This can improve the recycling potential of the brush-holder 112.

The use of the spring 124 can simplify the configuration for imparting tension to the brush-holder 112.

The pin-shaped protrusion 123 passes through the through-hole 115 of the brush-holder 112. The pin-shaped protrusion 123 protrudes from the front surface of the rising part 121 diagonally to the right, in the longitudinal direction of the brush-holder 112. Because the spring 124 is provided on the left side of the rising part 121, the pin-shaped protrusion 123 protrudes in a direction away from the spring 124. The direction, in which the pin-shaped protrusion 123 extends from the through-hole 115, is inclined towards the direction opposite to the direction in which the spring 124 pulls the brush-holder 112. This can prevent the brush-holder 112 from separating undesirably from the pin-shaped protrusion 123 at the through-hole 115.

Since the brush-holder 112 is formed from a film-shape thin metal plate and is electrically conductive, a cleaning bias can be applied to the brush member 31 through the brush-holder 112. The thus applied bias can improve the deposit removal capability of the brush member 31.

In addition, since the hook portion 125 acts as an electrode for applying the cleaning bias to the brush member 31, the number of components in the process cartridge 18 can be reduced.

Since the brush-holder 112 has a film shape, the distance between the rising part 121 and the photosensitive drum 28 in the facing direction (front-to-rear direction) can be reduced. For that reason, the process cartridge 18 can be made compact.

The laser printer 1 is provided with the process cartridge 18 that can achieve uniform removal of deposits such as paper dust that adhere to the surface of the photosensitive drum 28. Such deposits adhering to the surface of the photosensitive drum 28 can be removed cleanly. This prevents deposits on the surface of the photosensitive drum 28 from giving undesirable effects on image quality, enabling the formation of a high-quality image.

While the invention has been described in detail with reference to the specific embodiment thereof, it would be apparent to those skilled in the art that various changes and modifications may be made therein without departing from the spirit of the invention.

<First Modification>

Figure 6:
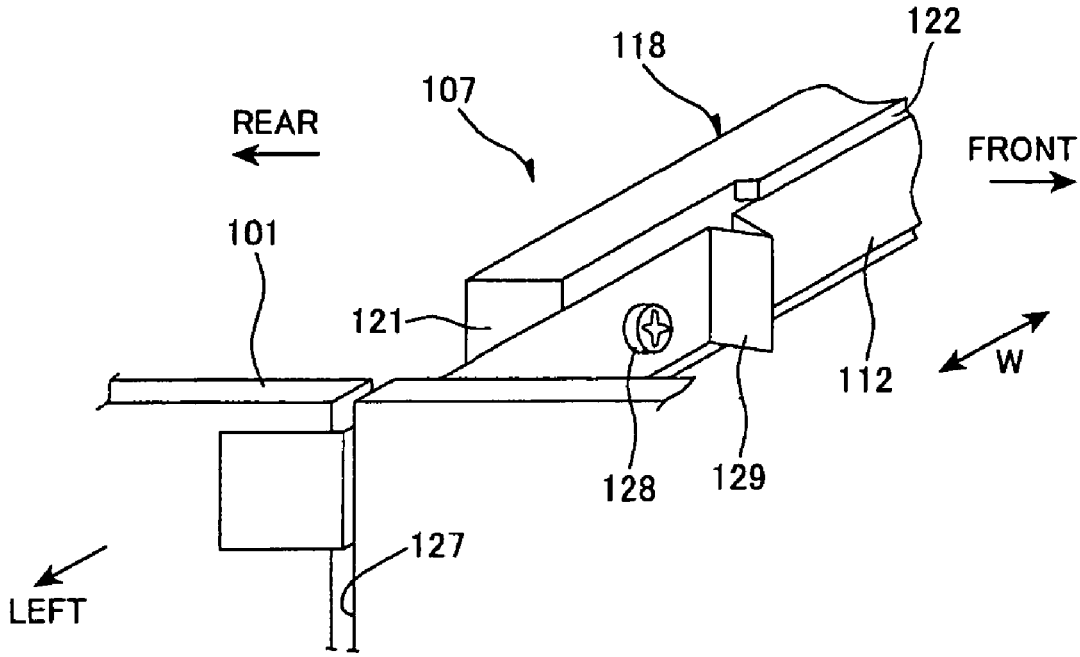
FIG. 6 is a perspective view of an essential portion of the left end portion of the lower frame according to a first modification.

For example, according to a first modification, the brush accommodating portion 107 and the brush-holder 112 are modified as shown in FIG. 6. Note that portions corresponding to components that are the same as those in the above-described embodiment are denoted by the same reference numbers in FIG. 6 and further description thereof is omitted.

In the brush accommodating portion 107 of this modification, the engagement protrusion 119 and the aperture 120 shown in FIG. 5 are not provided in the brush left-side wall portion 101. Instead, an incised groove 127 is formed to extend downward from the upper edge of the brush left-side wall portion 101.

The brush-support wall 118 is disposed at a position substantially facing the incised groove 127 in the widthwise direction W. More specifically, the position, in the front-to-rear direction, of the front surface of the rising part 121 that faces the photosensitive drum 28 is substantially the same as the position of the incised groove 127 in the front-to-rear direction.

The brush-holder 112, which is formed of a film-shaped thin metal plate, extends longitudinally in the widthwise direction W, with its left end passing through the incised groove 127 and being bent towards the rear along the outer surface of the brush left-side wall portion 101 in the widthwise direction W. Thus, the brush-holder 112 is engaged with the brush left-side wall portion 101 at its left end portion at the incised groove 127. The brush-holder 112 is fastened to the left end portion of the rising part 121 of the brush-support wall 118 by a screw 128. The brush-holder 112 is formed with a leaf spring portion 129 in the vicinity of the right side of the screw 128. The leaf spring portion 129 is formed by bending an intermediate portion of the brush-holder 112 into a substantially V shape protruding towards the photosensitive drum 28 (see FIG. 1). The left end portion of the brush-holder 112 exposed on the outside surface of the brush left-side wall portion 101 serves as an electrode that is applied with a cleaning bias.

With this configuration, tension is imparted also to the brush-holder 112 in the longitudinal direction thereof (the widthwise direction W) by the spring force of the leaf spring portion 129. For that reason, a high level of surface accuracy can be achieved on the brush-holding part 113 of the brush-holder 112, regardless of the mounting precision at which the brush-holder 112 is mounted on the brush-support wall 118. As a result, the brush member 31 can be held uniformly in contact with the surface of the photosensitive drum 28. Deposits adhering to the surface of the photosensitive drum 28 can therefore be removed uniformly.

Because the leaf spring portion 129 is formed in part of the brush-holder 112, the number of components can be reduced.

The screw 128 may be omitted because the left end portion of the brush-holder 112 may be fixedly fastened to the brush left-side wall portion 101 by being engaged in the incised groove 127.

<Second Modification>

Figure 7:
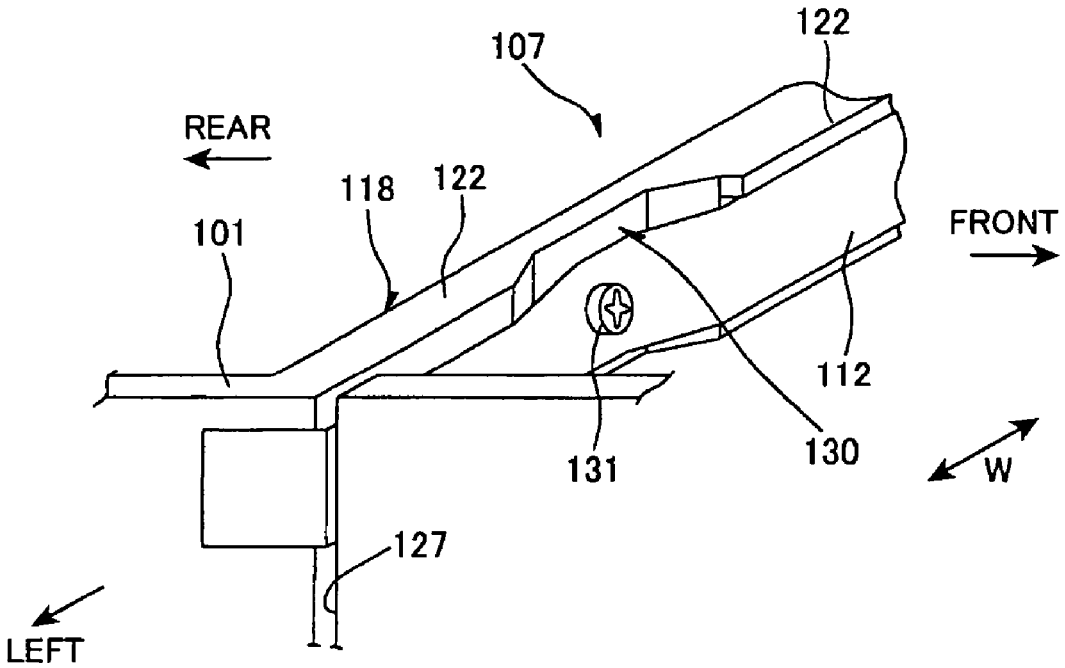
FIG. 7 is a perspective view of an essential portion of the left end portion of the lower frame according to a second modification.

According to a second modification, the brush accommodating portion 107 and the brush-holder 112 are modified as shown in FIG. 7. Note that portions corresponding to components that are the same as those in the above-described first modification are denoted by the same reference numbers in FIG. 6 and further description thereof is omitted.

In the brush accommodating portion 107 of this modification, the brush-support wall 118 is formed integrally with the brush left-side wall portion 101. The incised groove 127 is formed at a position that is located on the same plane with the front surface of the brush-support wall 118 that faces the photosensitive drum 28.

Similarly to the first modification described above, the incised groove 127 extends downward from the upper edge of the brush left-side wall portion 101. The left end portion of the brush-holder 112 passes through the incised groove 127 and is bent towards the rear along the outer surface of the brush left-side wall portion 101 in the widthwise direction W, and is engaged with the incised groove 127.

An indented portion 130 is formed on the front surface of the brush-support wall 118 at a position in the vicinity of the brush left-side wall portion 101. The indented portion 130 descends rearwardly. In other words, the front surface of the brush-support wall 118 within the indented portion 130 is more distant away from the photosensitive drum 28 than the front surface of the brush-support wall 118 at portions other than the indented portion 130.

After the brush-holder 112 is mounted on the brush-support wall 118 in a straight line along its longitudinal direction (widthwise direction W), a screw 131 passes through the brush-holder 112 at its position that faces the indented portion 130. The screw 131 is screwed into the brush-support wall 118 within the indented portion 130. As a result, a portion of the brush-holder 112 facing the indented portion 130 is pressed toward the brush-support wall 118, and is disposed within the indented portion 130. This ensures that tension is generated reliably, on both sides of the brush-holder 112 with respect to the screw 131 in the longitudinal direction of the brush-holder 112 (widthwise direction W). For that reason, tension can be imparted reliably to the brush-holder 112 in the longitudinal direction thereof, with a simple configuration.

What is claimed is:

1. A cartridge, comprising:

an image bearing body that bears an image on its surface, wherein the image bearing body rotates;

a brush member that removes deposits adhered to the surface of the image bearing body;

a brush holder member that extends along a longitudinal direction of the image bearing body and that holds the brush member;

a tension imparting portion that imparts tension to the brush holder member in the longitudinal direction of the image bearing body by being configured to pull the brush holder member toward the tension imparting portion; and a regulation member which is provided on the downstream side of the brush holder member in the direction of rotation of the image bearing body and which regulates the movement of the brush holder member downstream in the direction of rotation of the image bearing body.

2. A cartridge, comprising:

an image bearing body that bears an image on its surface;

a brush member that removes deposits adhered to the surface of the image bearing body;

a brush holder member that extends along a longitudinal direction of the image bearing body and that holds the brush member;

a tension imparting portion that imparts tension to the brush holder member in the longitudinal direction of the image bearing body by being configured to pull the brush holder member toward the tension imparting portion;

a housing that accommodates the image bearing body therein:

a disposition portion, which is provided in the housing, and on which the brush holder member is disposed; and a first fastening portion and a second fastening portion that are provided on opposite end sides of the brush holder member in the longitudinal direction and that fasten the brush holder member to the disposition portion;

wherein the tension imparting portion is located between the first fastening portion and the second fastening portion.

3. The cartridge as claimed in claim 2, wherein the first fastening portion includes a protrusion formed on the disposition portion, the protrusion passing through an aperture which is formed through the brush holder member at its one end portion in its longitudinal direction.

4. The cartridge as claimed in claim 3, wherein the protrusion protrudes from a disposition surface of the disposition portion, on which the brush holder member is disposed, in a direction diagonally to a side opposite to the side on which the tension imparting portion is provided in the longitudinal direction of the brush holder member.

5. The cartridge as claimed in claim 2, wherein the tension imparting portion includes a spring, one end of the spring being connected to the other end portion of the brush holder member in the longitudinal direction thereof; and the second fastening portion includes:

a fixing portion provided in the housing; and an engagement portion which is provided at the other end of the spring and which engages with the fixing portion.

6. The cartridge as claimed in claim 5, wherein the spring is disposed on a side on which the disposition portion is located with respect to the brush holder member, the spring pulling the other end portion of the brush holder member in the longitudinal direction thereof in a direction crossing the longitudinal direction of the brush holder member.

7. The cartridge as claimed in claim 5, wherein the engagement portion is electrically conductive and applies the brush member with an electric bias voltage.

8. The cartridge as claimed in claim 2, wherein the tension imparting portion includes a leaf spring portion that is formed by bending a part of the brush holder member.

9. The cartridge as claimed in claim 2, wherein the tension imparting portion includes a pressing portion that presses part of the brush holder member towards the side on which the disposition portion is provided, in a state in which the brush holder member is fastened on the disposition portion in a straight line along the longitudinal direction of the brush holder member.

10. The cartridge as claimed in claim 9, wherein:

the disposition portion is formed with an indented portion that descends in the pressing direction of the pressing portion; and a part of the brush holder member is disposed within the indented portion by the pressure of the pressing portion.

11. The cartridge as claimed in claim 2, wherein the brush holder member is electrically conductive.

12. The cartridge as claimed in claim 2, wherein the brush holder member is flexible.

13. The cartridge as claimed in claim 1, wherein the brush holder member is formed in a film shape.

14. The cartridge as claimed in claim 1, further comprising:

a main cartridge housing that houses therein the image bearing body, the brush member, the brush holder member, and the tension imparting portion; and an additional cartridge that is detachably attached to the main cartridge housing and that includes a developing member, the developing member supplying a developing agent to the image bearing body, thereby forming the image on the image bearing body.

15. The cartridge as claimed in claim 2, wherein the brush member includes a support member and fibers planted on the support member, the brush holder member holding the support member.

16. The cartridge as claimed in claim 2, where in the image bearing body has a rotational shaft that extends along the longitudinal direction of the image bearing body.

17. A drum cartridge, comprising:

an image bearing drum that bears an image on its surface;

a brush member that removes deposits adhered to the surface of the image bearing drum;

a brush holder member that extends along a longitudinal direction of the image bearing drum and that holds the brush member;

a tension imparting portion that imparts tension to the brush holder member in the longitudinal direction of the image bearing drum by being configured to pull the brush holder member toward the tension imparting portion;

a housing that accommodates the image bearing drum therein;

a disposition portion, which is provided in the housing, and on which the brush holder member is disposed; and a first fastening portion and a second fastening portion that are provided on opposite end sides of the brush holder member in the longitudinal direction and that fasten the brush holder member to the disposition portion, wherein the tension imparting portion is located between the first fastening portion and the second fastening portion.

18. A process cartridge, comprising:

a drum cartridge, including:

an image bearing drum that bears an image on its surface;

a brush member that removes deposits adhered to the surface of the image bearing drum;

a brush holder member that extends along a longitudinal direction of the image bearing drum and that holds the brush member; and a tension imparting portion that imparts tension to the brush holder member in the longitudinal direction thereof by being configured to pull the brush holder member toward the tension imparting portion;

a developing cartridge that is detachably attached to the drum cartridge, the developing cartridge including a developing roller that supplies toner to the image bearing drum, thereby forming the image on the image bearing drum;

a housing that accommodates the image bearing drum therein;

a disposition portion, which is provided in the housing, and on which the brush holder member is disposed; and a first fastening portion and a second fastening portion that are provided on opposite end sides of the brush holder member in the longitudinal direction and that fasten the brush holder member to the disposition portion, wherein the tension imparting portion is located between the first fastening portion and the second fastening portion.

19. An image forming device, comprising:

a cartridge, including:

an image bearing body that bears an image on its surface;

a brush member that removes deposits adhered to the surface of the image bearing body;

a brush holder member that extends along a longitudinal direction of the image bearing body and that holds the brush member; and a tension imparting portion that imparts tension to the brush holder member in the longitudinal direction of the image bearing body by being configured to pull the brush holder member toward the tension imparting portion;

a conveying device that conveys a recording medium to the image bearing body, the recording medium receiving the image transferred from the image bearing body;

a housing that accommodates the image bearing body therein;

a disposition portion, which is provided in the housing, and on which the brush holder member is disposed; and a first fastening portion and a second fastening portion that are provided on opposite end sides of the brush holder member in the longitudinal direction and that fastening the brush holder member to the disposition portion, wherein the tension imparting portion is located between the first fastening portion and the second fastening portion.

* * * * *